US009328505B1

(12) United States Patent
Blackburn et al.

(10) Patent No.: US 9,328,505 B1
(45) Date of Patent: May 3, 2016

(54) SNAP FASTENER FOR SHEET MATERIAL

(71) Applicants: Gerald Blackburn, Winter Park, FL (US); Ric Cadwallader, Winter Park, FL (US)

(72) Inventors: Gerald Blackburn, Winter Park, FL (US); Ric Cadwallader, Winter Park, FL (US)

( * ) Notice: Subject to any disclaimer, the term of this patent is extended or adjusted under 35 U.S.C. 154(b) by 214 days.

(21) Appl. No.: 13/938,167

(22) Filed: Jul. 9, 2013

Related U.S. Application Data

(60) Provisional application No. 61/669,250, filed on Jul. 9, 2012.

(51) Int. Cl.
*E04B 1/38* (2006.01)
*E04B 1/41* (2006.01)

(52) U.S. Cl.
CPC ..... *E04B 1/40* (2013.01); *Y10T 29/4995* (2015.01); *Y10T 29/49551* (2015.01); *Y10T 29/49959* (2015.01)

(58) Field of Classification Search
CPC ..... Y10T 29/4995; Y10T 29/29952; Y10T 29/49961; Y10T 29/49959; Y10T 29/551; Y10T 29/49952; Y10T 29/49551
See application file for complete search history.

(56) References Cited

U.S. PATENT DOCUMENTS 4,074,501 A * 2/1978 Sandqvist ..... 52/741.4
4,410,027 A * 10/1983 Lucous ..... 160/380
4,586,301 A * 5/1986 Hickman ..... 52/96
5,095,068 A * 3/1992 Chiu ..... 524/525
6,314,684 B1 * 11/2001 Aviram ..... 52/11

* cited by examiner

*Primary Examiner* — Jason L Vaughan
*Assistant Examiner* — Amanda Meneghini
(74) *Attorney, Agent, or Firm* — Allen Dyer Doppelt Milbrath & Gilchrist

(57) ABSTRACT

A snap fastener includes releasable connectable first and second fastener sections. The first fastener section has a first section central portion with a pair of upwardly extending first section sidewalls located along opposite first section edges thereof, each sidewall including an inwardly extending engagement arm. The second fastener section has a second section central portion with first and second downwardly extending second section sidewalls located along opposite second section edges thereof, respective first and second engagement portions being connected to the first and second second section sidewalls by inwardly extending first and second legs. The first and second fastener sections are releasably connectable to secure a sheet material therebetween by securing the first and second engagement portions under the first and second engagement arms. Snap fasteners can be used to releasably secure sheet material to an underlying surface, and over a mate line between roofs of two pre-fabricated building sections.

18 Claims, 4 Drawing Sheets

SNAP FASTENER FOR SHEET MATERIAL

CROSS-REFERENCE TO RELATED APPLICATION

This application claims the benefit of U.S. Provisional Patent Application Ser. No. 61/669,250, filed on Jul. 9, 2012, the contents of which are herein incorporated by reference in their entirety.

FIELD OF THE INVENTION

The present invention relates to fasteners used in construction applications, and more particularly, to fasteners for securing sheet material to building structures.

BACKGROUND OF THE INVENTION

There are many instances in building construction (including new construction, renovation, remodels, etc.) when it is necessary or desirable to secure a sheet of material to an underlying structural member or members. For example, when assembling adjacent pre-fabricated building sections on site, there is a joint in the roof between the sections (referred to as the "mate-line"). A sheet of heavy duty polymeric material, such as ethylene propylene diene monomer (EPDM) rubber, is frequently used to cover this joint and make it weather-tight. Various adhesives and/or mechanical connectors are employed to secure the sheet to the roofs of the adjacent building sections. Although existing adhesives and/or connectors can offer acceptable performance in connecting sheet material to underlying structure(s), further improvements are possible.

SUMMARY OF THE INVENTION

In view of the foregoing, it is an object of the present invention to provide an improved snap fastener for sheet material. According to an embodiment of the present invention, a snap fastener includes first and second fastener sections. The first fastener section has a first section central portion with a pair of upwardly extending first section sidewalls located along opposite first section edges thereof, each sidewall including an inwardly extending engagement arm. The second fastener section has a second section central portion with first and second downwardly extending second section sidewalls located along opposite second section edges thereof, respective first and second engagement portions being connected to the first and second second section sidewalls by inwardly extending first and second legs. The first and second fastener sections are releasably connectable to secure a sheet material therebetween by securing the first and second engagement portions under the first and second engagement arms.

According to an aspect of the present invention, the first leg extends inwardly generally perpendicular to the first sidewall and the second leg curves inwardly and downwardly from the second sidewall. According to another aspect of the present invention, the first engagement and second engagement portions include respective first and second outwardly-extending protrusions, the second protrusion extending outwardly to a greater extent than the first protrusion. According to a further aspect of the present invention, the second fastener section includes a lip overhanging the first second section sidewall.

According to a method aspect of the invention, a method of releasably securing a sheet material to an underlying surface includes affixing an elongated first fastener section having upwardly extending first section sidewalls to the underlying surface, arranging the sheet material over the first fastener section, and connecting an elongated second fastener section having downwardly extending second section sidewalls to the first fastener section such that the sheet material is secured between interlocking engagement arms and engagement portions of the first and second fastener sections. Advantageously, the underlying surface is a roof of a first pre-fabricated modular building section and arranging the sheet material includes arranging the sheet material over a mate line between the first pre-fabricated modular building section and a second pre-fabricated modular building section. According to additional aspect, one of the engagement portions is connected to its sidewall by a curved leg, and connecting the elongated second fastener section includes interlocking the engagement portion with the curved leg with one of the engagement arms more distant from the mate line. According to another aspect, the engagement portion with the curved leg is interlocked with one of the engagement arms before interlocking another one of the engagement portions with another one of the engagement arms.

These and other objects, aspects and advantages of the present invention will be better appreciated in view of the drawings and following detailed description of a preferred embodiment.

DETAILED DESCRIPTION OF A PREFERRED EMBODIMENT

Figure 1:
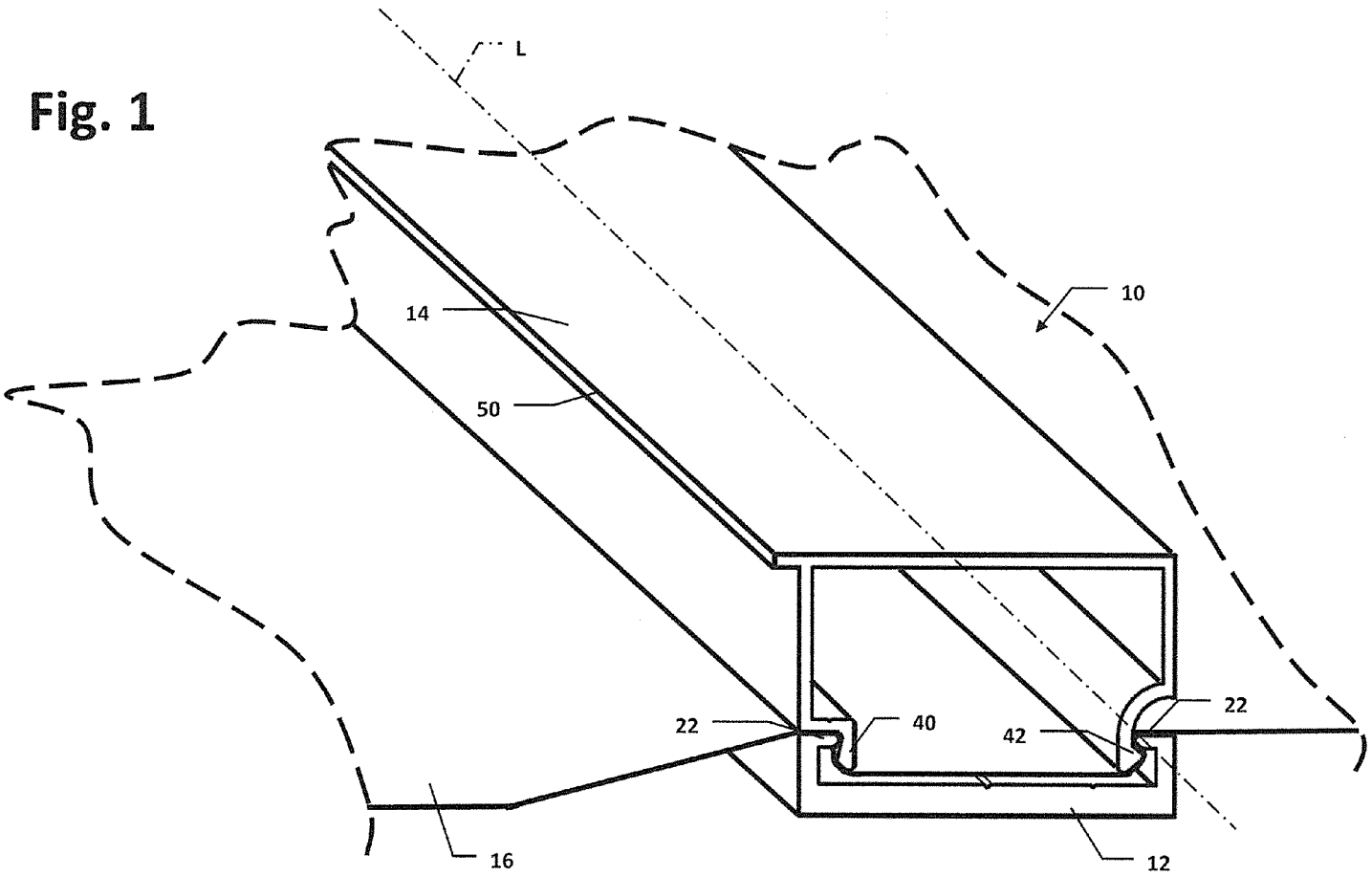
FIG. 1 is a partial perspective view of a snap fastener, including first and second sections, according to an embodiment of the present invention.

According to an embodiment of the present invention, referring to FIG. 1, a snap fastener 10 includes releasably connected first and second fastener sections 12, 14 operable to securely hold a sheet 16 of material therebetween. With the first section 12 secured to an underlying structure, the snap fastener 10 will hold the sheet 16 to the underlying structure.

The snap fastener 10, and its sections 12, 14, are elongated in a length direction L; any suitable length can be selected therefor based on application requirements and other design considerations. Preferred dimensions for the sections 12, 14 appear in FIGS. 2-5 (in inches for linear measurements and degrees for angular measurements), although the present invention is not necessarily limited thereto. The fastener sections 12, 14 can be made out of any suitable material, although extruded aluminum is particularly advantageous for its strength, weight, ease of use and manufacture, and corrosion resistance characteristics.

Figure 2:
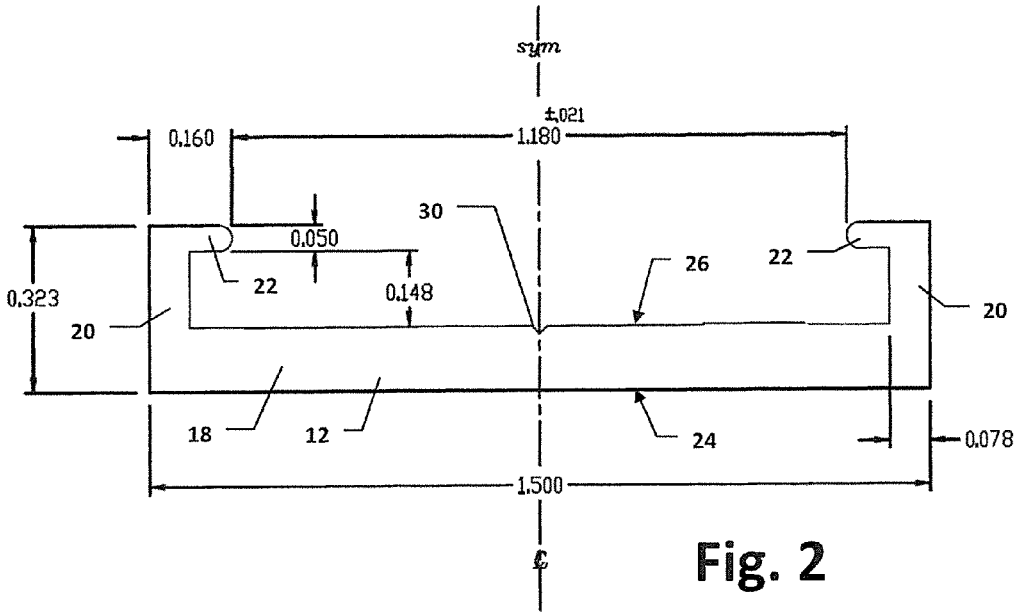
FIG. 2 is an end view of the first section of FIG. 1.

Referring to FIG. 2, the first fastener section 12 includes a central portion 18 with upwardly-extending sidewalls 20 (directions being relative to the orientation of the FIG. 2) located along opposite edges thereof. Each sidewall 20 includes an inwardly extending engagement arm 22, giving the first section a generally C-shaped cross-section. The engagement arms 22 are preferably rounded at distal ends thereof and extend generally perpendicularly to the sidewalls 20.

The central portion 18 has lower and upper surfaces 24, 26. In use, the lower surface 24 will ordinarily be oriented toward the underlying structure. An alignment notch 30 is defined (extending in the direction L) in the center of the upper surface 26 to aid in the placement of screws or fasteners when securing the first section to the underlying surface.

Figure 3:
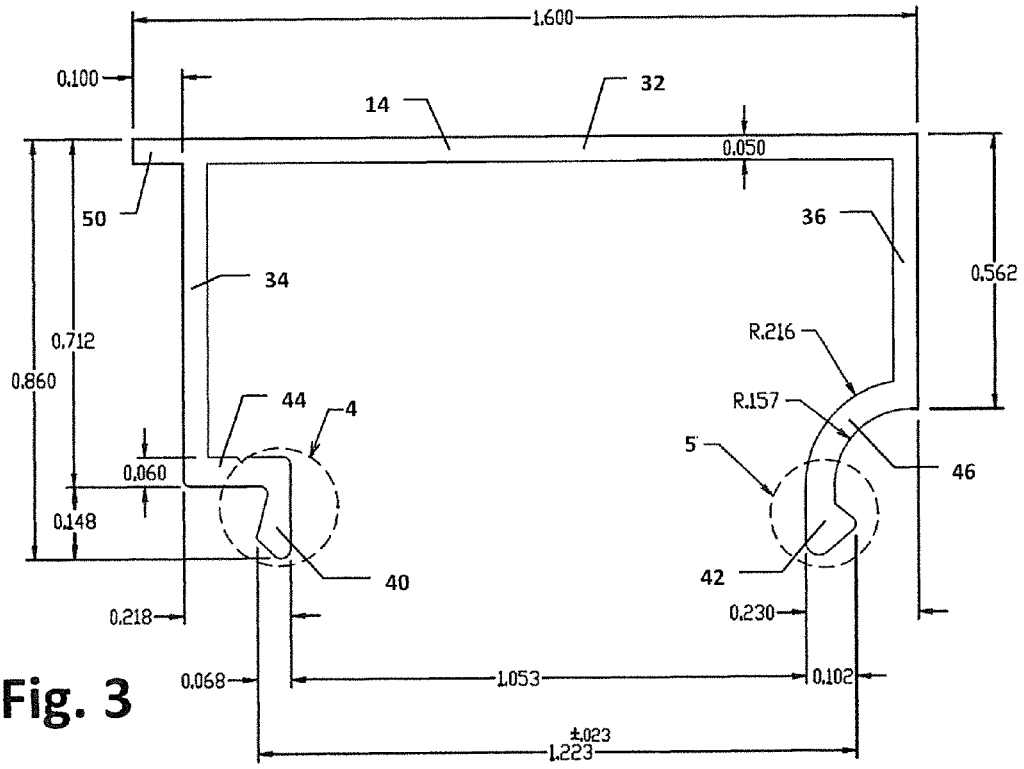
FIG. 3 is an end view of the second section of FIG. 1.

Referring to FIG. 3, the second fastener section 14 includes a central portion 32 with downwardly-extending first and second sidewalls 34, 36 (directions being relative to the orientation of the FIG. 3) located along opposite edges thereof. First and second engagement portions 40, 42 are connected to the first and second sidewalls 34, 36, respectively, by inwardly extending first and second legs 44, 46. The first leg 44 extends inwardly generally perpendicular to the first sidewall 34, while the second leg 46 curves inwardly and downwardly from the second sidewall 36. A lip 50 overhangs the first sidewall 34 generally co-planar with the central portion 32.

Figure 4:
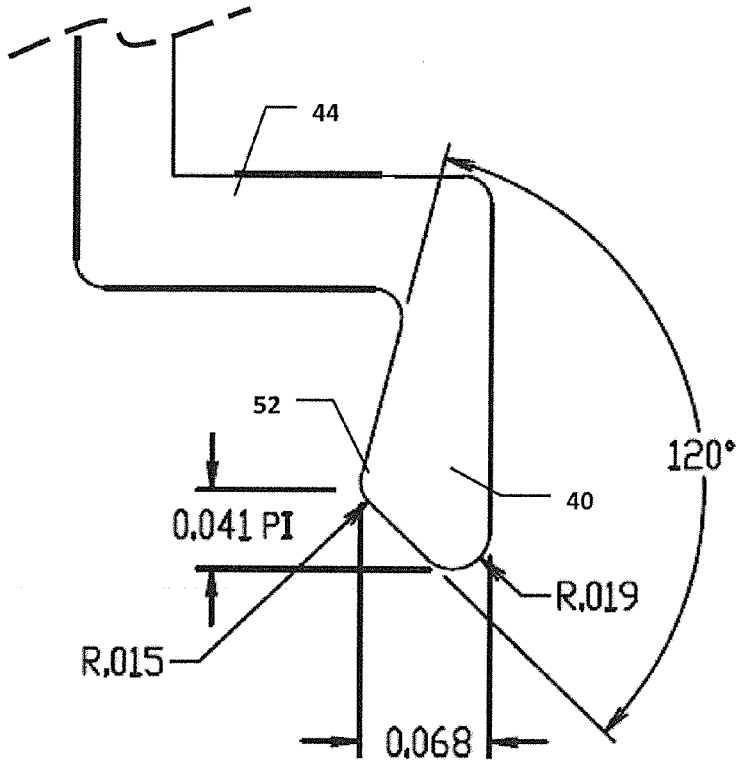
FIG. 4 is a detailed end view of area 4 of FIG. 3.
Figure 5:
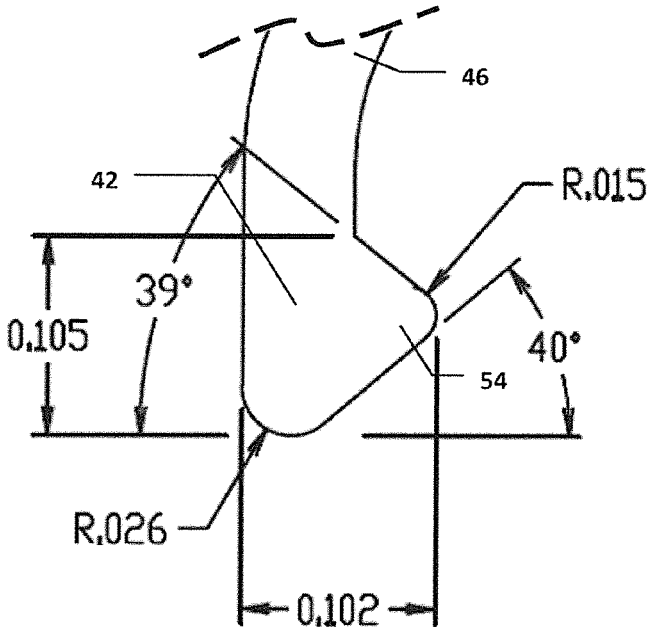
FIG. 5 is a detailed end view of area 5 of FIG. 3.

Referring to FIGS. 4 and 5, the first engagement portion 40 includes a first outwardly-extending protrusion 52 and the second engagement portion 42 includes a second outwardly-extending protrusion 54, with the second protrusion 54 extending outwardly to a greater extent than the first protrusion. Corners of the protrusions 52, 54, are preferably rounded.

Referring again to FIG. 1, the first and second engagement portions 40, 42 are secured under the engagement arms 22 with the sheet 16 of material routed therebetween. Advantageously, when securing the first and second fastener sections 12, 14, the second engagement portion 42 is engaged first under one of the engagement arms 22. Assisted by the curved second leg 46, the second section 14 is pivoted to engage the first engagement portion 40 under the other engagement arm 22.

Cumulatively, the first and second fastener sections 12, 14 are flexible enough to allow this engagement to be made under external urging, but rigid enough to retain the engagement once made absent a significant external force. The lip 50 can be used to facilitate un-making the engagement of the first and second fastener sections 12, 14. By striking the underside of the lip 50 with a mallet, the first engagement portion 40 can be popped out from under its corresponding engagement arm 22. The second section 14 can and the sheet 16 can then be removed. The snap fastener 10 and the sheet 16 can then all be re-used.

Figure 6:
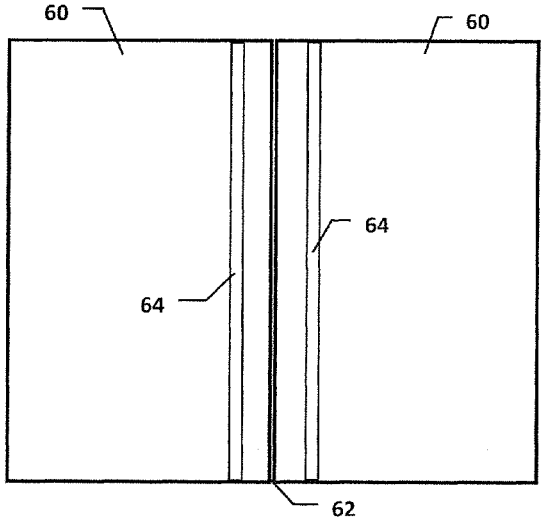
FIGS. 6-9 are schematic top views of the use of snap fasteners according to FIG. 1 on adjacent building sections.

A particularly advantageous use of the snap fastener 10 will be described with reference to FIGS. 6-9. Referring to FIG. 6, two building sections 60 are placed adjacent to one another with a joint 62 in between. For example, the building sections 60 can be two halves of a pre-fabricated modular building, with the joint 62 being the mate-line between roofs thereof. Strips 64 of adhesive tape, such as self-sealing butylene tape, are arranged on either side of the joint 62.

Figure 7:
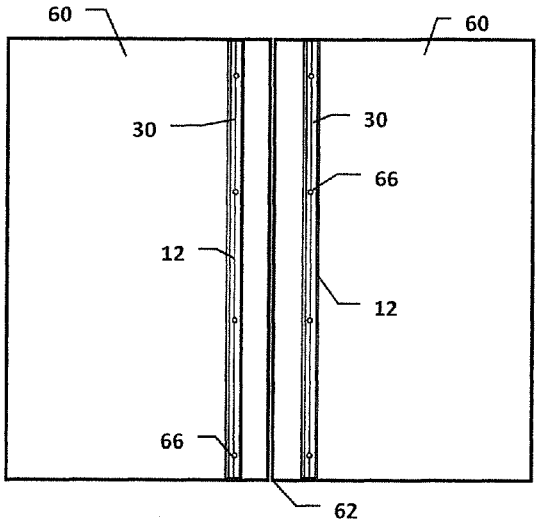
Figure 8:
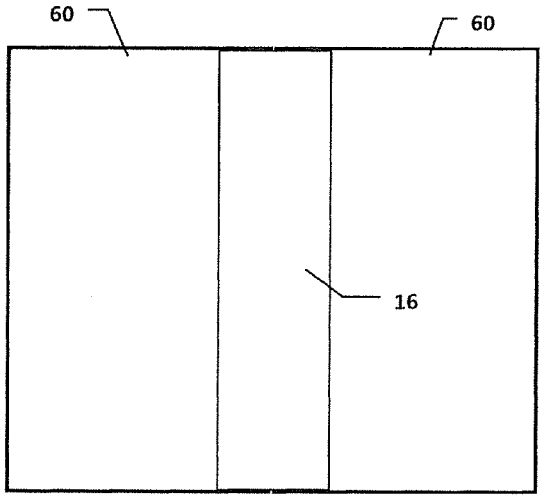
Figure 9:
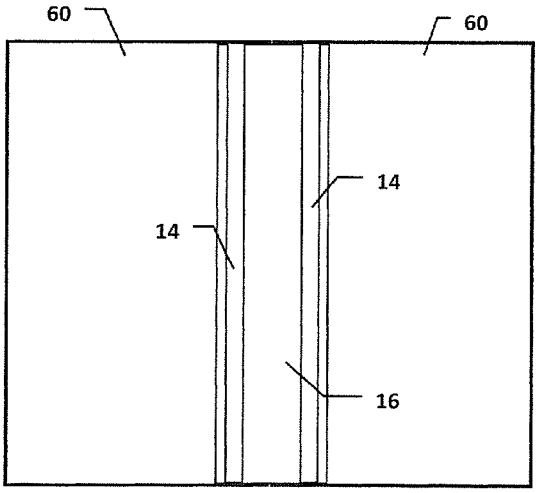

Referring to FIG. 7, first fastener sections 12 are attached to the building sections 60 by the tape 64. To further secure the first sections 12, screws 66 are driven therethrough, guided by the alignment notch 30. The self-sealing tape will automatically seal around the screws 66. Referring to FIG. 8, the sheet 16 is laid across the joint 62 and both first fastener sections 12. In FIG. 9, the second fastener sections 14 are secured to the first sections 12, in the manner described above, to secure the sheet 16 to the building sections 60 across the joint. Preferably, the lips 50 of the second sections 14 (see FIGS. 1 and 3) are both oriented toward the joint 62.

If the building formed by the sections 60 is to be moved, the second fastener sections 14 and the sheet 16 can be readily removed in the manner described above. The building sections 60 can then be moved, and when re-assembled at a new location, the sheet 16 (or a new sheet) need only be replaced and the second sections 14 re-attached. It will be appreciated that a significant savings in time and materials can be thereby realized.

The above embodiment is provided for exemplary and illustrative purposes. Those skilled in the art will appreciate that the present invention is not necessarily limited to such an embodiment. Rather, numerous modifications, and adaptations for particular circumstances, fall within the scope of the invention as herein shown and described and of the claims appended hereto.

What is claimed is:

1. A snap fastener comprising:

a first fastener section having a first section central portion with a pair of upwardly extending first section sidewalls located along opposite first section edges thereof, each first section sidewall including an inwardly extending engagement arm; and a second fastener section having a second section central portion with first and second downwardly extending second section sidewalls located along opposite second section edges thereof, respective first and second engagement portions being connected to the first and second second section sidewalls by inwardly extending first and second legs;

wherein the first and second fastener sections are releasably connectable to secure a sheet material therebetween by securing the first and second engagement portions under the first and second engagement arms; and wherein the first leg extends inwardly generally perpendicular to the first second section sidewall and the second leg curves inwardly and downwardly from the second second section sidewall, the second leg curve establishing a vertical clearance between the second second section sidewall and the underlying one of the pair of first section sidewalls when the first and second fastener sections are releasably connected.

2. The snap fastener of claim 1, wherein the snap fastener is elongated in a length direction parallel with the first and second section sidewalls.

3. The snap fastener of claim 1, wherein an alignment notch is defined in an upper surface of the first section central portion.

4. The snap fastener of claim 1, wherein the first section has a generally C-shaped cross-section.

5. The snap fastener of claim 1, wherein the engagement arms are rounded at distal ends thereof.

6. The snap fastener of claim 1, wherein the second fastener section includes a lip overhanging the first second section sidewall.

7. The snap fastener of claim 6, wherein the second protrusion extending outwardly to a greater extent than the first protrusion.

8. The snap fastener of claim 1, wherein the first engagement and second engagement portions include respective first and second outwardly-extending protrusions, the second protrusion extending outwardly to a greater extent than the first protrusion.

9. The snap fastener of claim 8, wherein corners of the first and second protrusions are rounded.

10. The snap fastener of claim 8, wherein the second fastener section includes a lip overhanging the first second section sidewall.

11. The snap fastener of claim 10, wherein the lip is generally co-planar with the second section central portion.

12. A method of releasably securing a sheet of material to an underlying surface, the method comprising:

affixing an elongated first fastener section having upwardly extending first section sidewalls to the underlying surface;

arranging the sheet of material over the first fastener section; and connecting an elongated second fastener section having downwardly extending second section sidewalls to the first fastener section such that the sheet of material is secured between interlocking engagement arms and engagement portions of the first and second fastener sections; and wherein the underlying surface is a roof of a first pre-fabricated modular building section and arranging the sheet material includes arranging the sheet material over a mate line between the first pre-fabricated modular building section and a second pre-fabricated modular building section.

13. The method of claim 12, further comprising arranging a strip of self-sealing adhesive tape on the underlying surface, over which the elongated first fastener section is affixed.

14. The method of claim 13, wherein affixing the elongated first fastener section includes inserting screws into the underlying surface through an alignment notch of the first fastener section and the sealing tape.

15. The method of claim 12, wherein one of the engagement portions is connected to its sidewall by a curved leg, and connecting the elongated second fastener section includes interlocking the engagement portion with the curved leg with one of the engagement arms before interlocking another one of the engagement portions with another one of the engagement arms.

16. The method of claim 12, wherein one of the engagement portions is connected to its sidewall by a curved leg, and connecting the elongated second fastener section includes interlocking the engagement portion with the curved leg with one of the engagement arms more distant from the mate line.

17. The method of claim 12, further comprising:

affixing an additional elongated first fastener section having upwardly extending first section sidewalls to a roof of the second pre-fabricated modular building section;

arranging the sheet of material over the additional first fastener section; and connecting an additional elongated second fastener section having downwardly extending second section sidewalls to the additional first fastener section such that the sheet of material is secured between interlocking engagement arms and engagement portions of the additional first and second fastener sections.

18. A snap fastener comprising:

a first fastener section having a first section central portion with a pair of upwardly extending first section sidewalls located along opposite first section edges thereof, each sidewall including an inwardly extending engagement arm; and a second fastener section having a second section central portion with first and second downwardly extending second section sidewalls located along opposite second section edges thereof, respective first and second engagement portions being connected to the first and second second section sidewalls by inwardly extending first and second legs, the first leg extending inwardly generally perpendicular to the first sidewall and the second leg curving inwardly and downwardly from the second sidewall, the first engagement and second engagement portions including respective first and second outwardly-extending protrusions, the second protrusion extending outwardly to a greater extent than the first protrusion, the second fastener section including a lip overhanging the first second section sidewall;

wherein the first and second fastener sections are releasably connectable to secure a sheet material therebetween by securing the first and second engagement portions under the engagement arms of the first section sidewalls, with the first second section sidewall extending upwardly from one of the first section sidewalls, such that the lip is spaced vertically apart from the secured sheet material.

* * * * *